US007824073B2

(12) United States Patent
Hsieh et al.

(10) Patent No.: US 7,824,073 B2
(45) Date of Patent: Nov. 2, 2010

(54) LIGHT SOURCE MODULE

(75) Inventors: Shu-Hui Hsieh, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 161 days.

(21) Appl. No.: 12/189,736

(22) Filed: Aug. 11, 2008

(65) Prior Publication Data

US 2009/0097242 A1 Apr. 16, 2009

(30) Foreign Application Priority Data

Oct. 11, 2007 (CN) ..... 2007 1 0202005

(51) Int. Cl.
*F21V 21/00* (2006.01)

(52) U.S. Cl. ..... 362/249.11; 362/249.06; 362/249.02

(58) Field of Classification Search ..... 362/249.01, 362/249.02, 249.06, 249.11, 234, 257
See application file for complete search history.

(56) References Cited

U.S. PATENT DOCUMENTS 6,851,831 B2 * 2/2005 Karlicek, Jr. ..... 362/249.06

7,621,655 B2 * 11/2009 Roberts et al. ..... 362/249.02

FOREIGN PATENT DOCUMENTS

CN 1702521 A 11/2005

OTHER PUBLICATIONS

Chien-Chih Chen et al., Sequential Color LED Backlight Driving System for LCD Panels, IEEE Transactions on Power Electronics, 919-925, vol. 22, No. 3, May 2007.

* cited by examiner

*Primary Examiner*—John A Ward
(74) *Attorney, Agent, or Firm*—Andrew C. Cheng

(57) ABSTRACT

A light source module includes light source units and links interconnecting the light source units. Each light source unit includes a substrate defining openings with a connector arranged in each opening. Each connector includes a first terminal and a second terminal. A light source is mounted on the substrate. The light source has a first electrode and a second electrode. The two electrodes are electrically connected to the terminals of the connectors. Each link is received in two openings of two neighboring light source units, and interconnects the two neighboring light source units electrically or mechanically.

15 Claims, 6 Drawing Sheets

LIGHT SOURCE MODULE

BACKGROUND

1. Field of the Invention

The present invention generally relates to a light source module incorporating light emitting diodes.

2. Description of Related Art

A typical light source module includes a light generating element and a light guiding element. Light emitting diodes (LEDs) have become widely used as light generating elements. The light emitted by the LEDs is converted to parallel light after passing through the light guiding element. However, the light generating element usually consists of a number of LEDs, each electrically connected to a power source via wire bonding, with a pair of gold threads electrically interconnecting electrodes of each LED and the power source. Thus, assembly of the light source module is difficult due to the complexity of the connection.

Therefore, a light source module is called for overcoming the described limitations.

SUMMARY

A light source module includes a plurality of light source units and a plurality of links interconnecting the light source units. Each light source unit includes a substrate defining a plurality of openings therein and a connector arranged in each opening. Each connector includes a first terminal and a second terminal. A light source is mounted on the substrate. The light source has a first electrode and a second electrode. The first and second electrodes of the light source are electrically connected to the first and second terminals of the connectors. Each link is received in two openings of two neighboring light source units, and interconnects the two neighboring light source units electrically or mechanically.

Other advantages and novel features will become more apparent from the following detailed description and when taken in conjunction with the attached drawings.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION OF THE INVENTION

Figure 1:
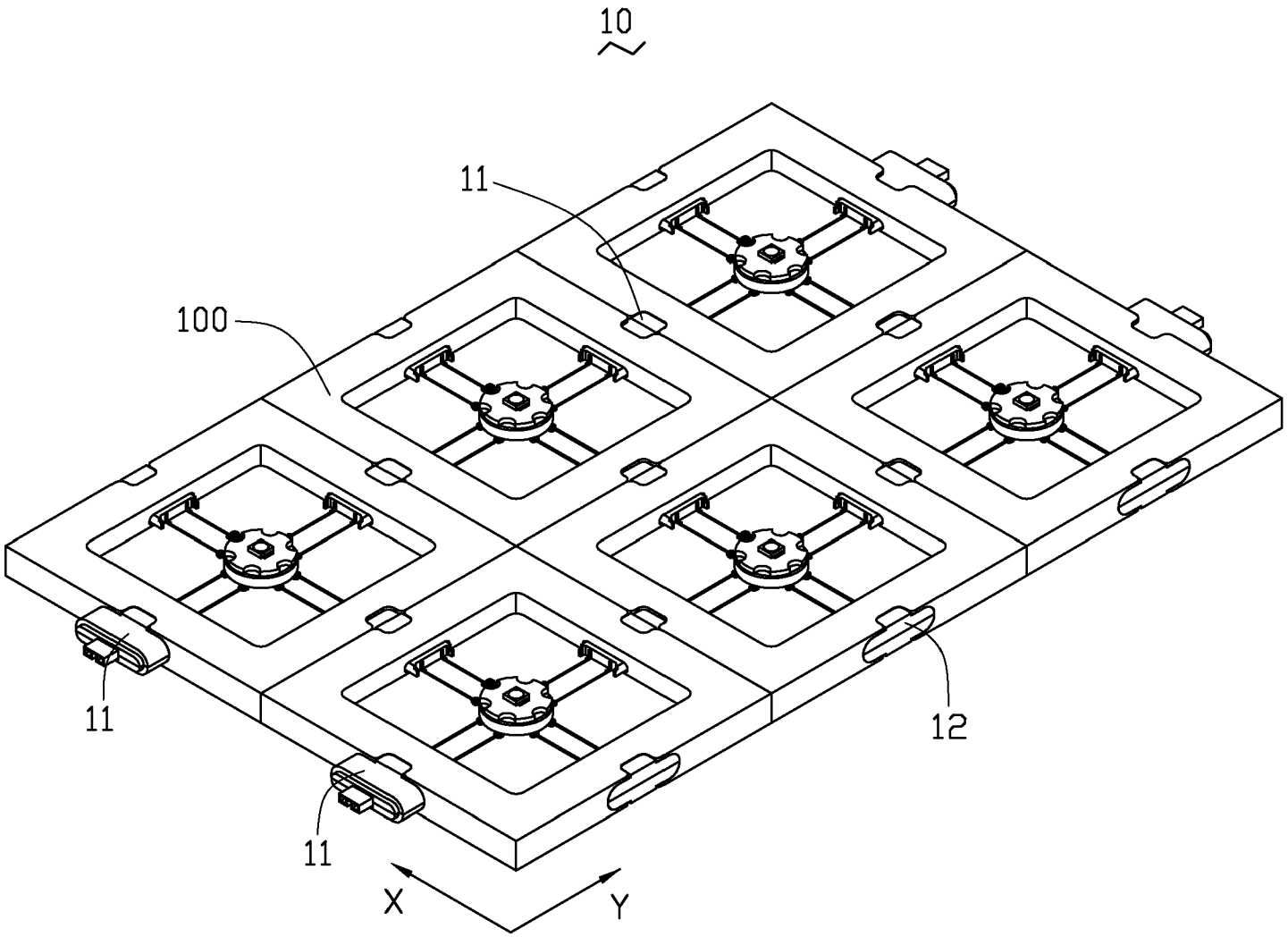
FIG. 1 is an assembled, isometric view of an embodiment of a light source module, the light source module including a plurality of light source units.

Reference will now be made to the drawings to describe embodiments. Referring to FIG. 1, the light source module 10 includes a plurality of light source units 100 and a plurality of links 11 connecting adjacent light source units 100.

Figure 2:
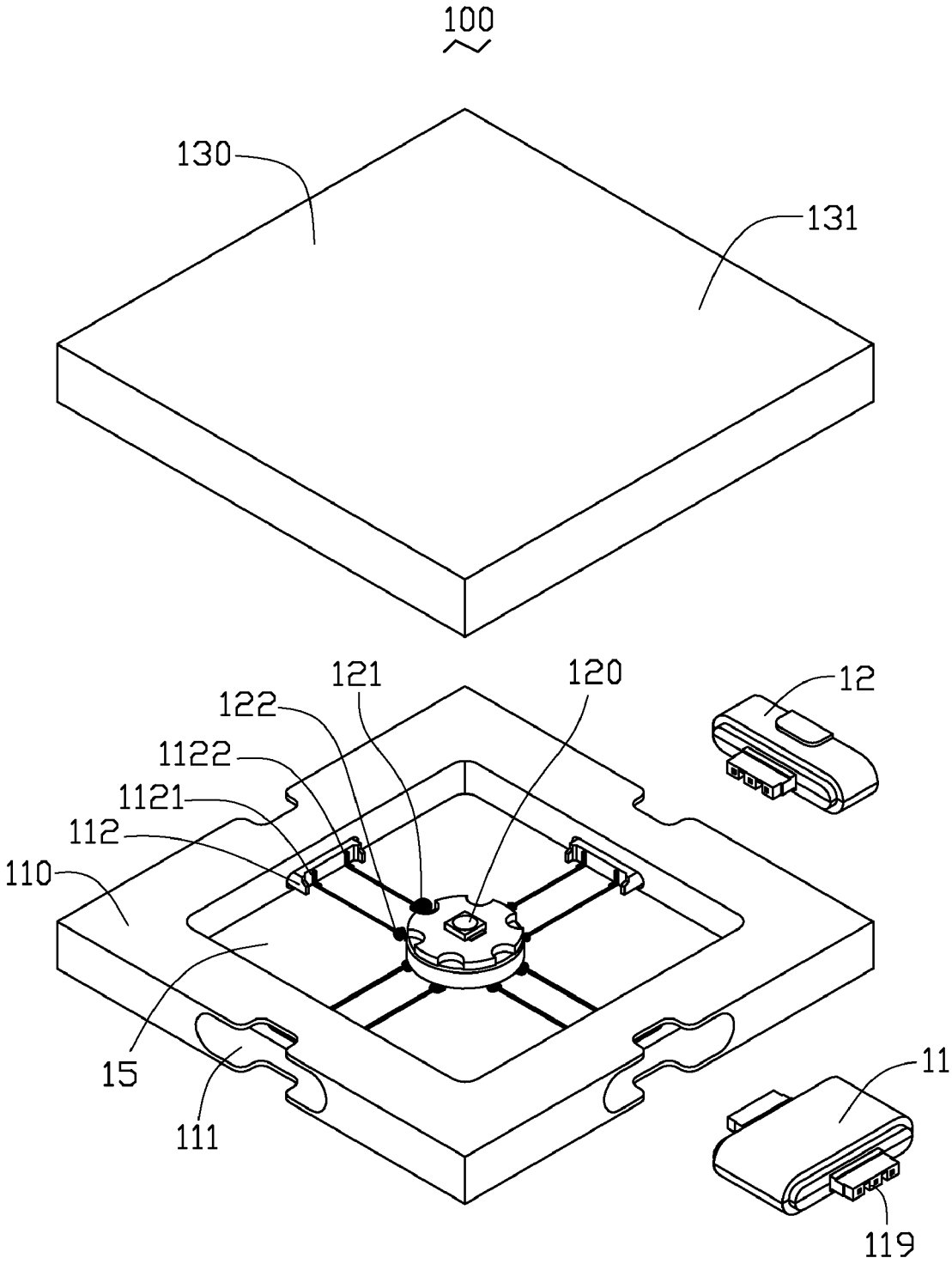
FIG. 2 is an exploded, isometric view of one embodiment of the light source unit of the light source module of FIG. 1, the light source unit including a light guiding plate.
Figure 3:
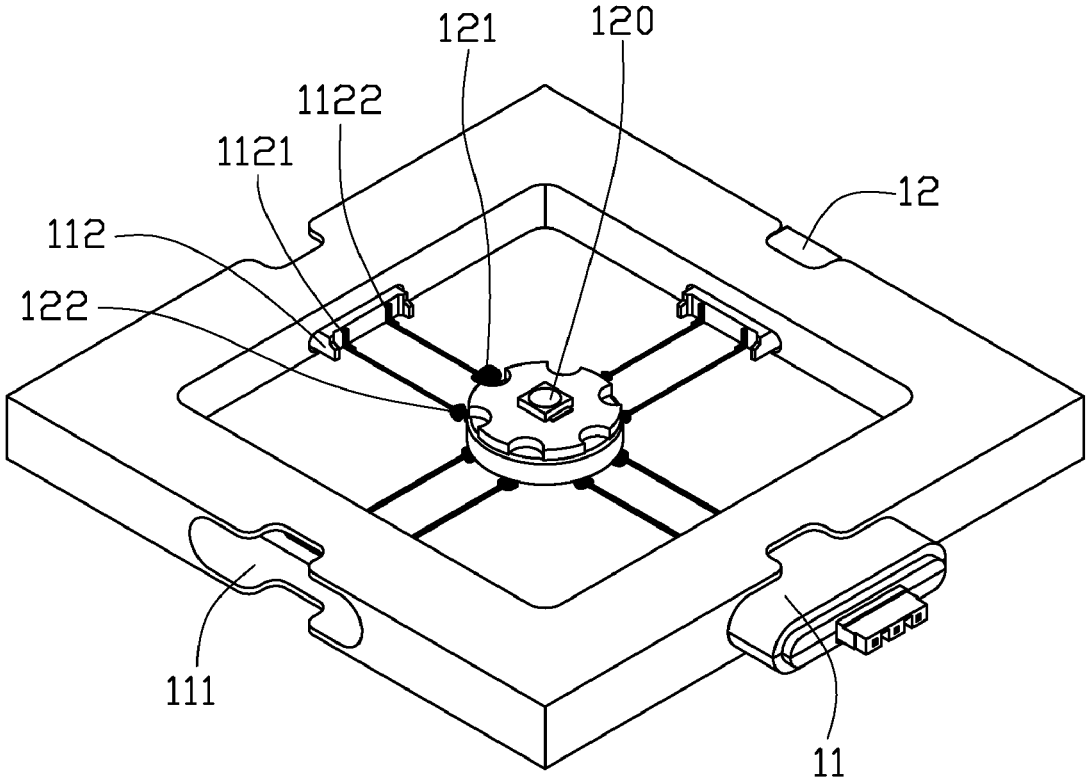
FIG. 3 is an assembled, isometric view of one embodiment of the light source unit of FIG. 2 shown without the light guiding plate.

Referring also to FIGS. 2-3, each light source unit 100 includes a substrate 15, a light source 120, and a light guiding plate 130. In the embodiment of FIG. 1, the substrate 15 is rectangular, e.g. square. In other embodiments, the substrate may be a diamond, hexagonal, triangular, or circular depending on the design of the light source units 100. A flange 110 extends from an outer periphery of the substrate 15. The light guiding plate 130 is optically coupled to a top surface of the flange 110 thereby defining a closed cavity for receiving the light source 120. In the embodiment of FIG. 1, the light source 120 is a light emitting diode (LED). The LED is mounted on the center of the substrate 15, such that the flange 110 surrounds the LED. The LED has a first electrode 121 electrically connected to a positive pole of a power source (not shown), and a second electrode 122 electrically connected to a negative pole. Each side of the flange 110 defines an opening 111 in the middle portion. A connector 112 is positioned in an inner side of the flange 110 corresponding to each opening 111. The connector 112 includes a pair of terminals 1121, 1122 electrically connected respectively, to the two electrodes 121, 122 of the LED.

The light guiding plate 130 on top converts light emitted by the LED into parallel light. The light guiding plate 130 is made of transparent material, such as polycarbonate (PC), polymethyl methacrylate (PMMA), polycacrylate, resin, glass, quartz, silicone, epoxy, or other. A light emitting surface 131 is formed on a top surface of the light guiding plate 130. In one embodiment, a plurality of micro-protrusions are formed on the light emitting surface 131 to create a rough surface for enhancing dispersion of the light guiding plate 130. In another embodiment, pores are defined in the light emitting surface 131. Preferably, each pore depth or micro-protrusion structure is not larger than 5 mm. A plurality of granules (not shown) are dispersed in the light guiding plate 130 for enhancing light diffusion, because light traversed through the light guiding plate 130 is usually parallel. The granules are made of a material having a refractive index different from that of the material of the light guiding plate 130, for example, $Al_2O_3$, $TiO_2$, $SiO_2$, $SiN_x$, $CaF_2$, $BaSO_4$, ZnO, $B_2O_3$, $Nb_2O_5$, $Na_2O$, or $Li_2O_5$. In one embodiment, a plurality of pores are defined in the light guiding plate 130 to enhance light diffusion.

In the embodiment of FIG. 1, the light source module 10 includes six light source units 100 arranged in two rows along the Y-axis by three lines along the X-axis. The links 11 connect the light source units 100 together to form the light source module 10. Each link 11 is symmetrical, with pins 119 formed at two opposite sides of each link. Adjacent light source units 100 cooperatively define a space to receive the link 11. The shape and size of the space is substantially the same shape and size of the link 11. The pins 119 engage with the terminals 1121, 1122 to form a connection between adjacent light source units 100 and engage with other devices such as the power source.

The link 11 can connect with the light source units 100 electrically or mechanically. As shown in FIG. 1, along the Y-axis, three light source units 100 of each row are electrically connected by two links 11. The pins 119 on one side of the link 11 connect to the terminals 1121, 1122 of one light source unit 100, and the pins 119 on the other side of the link 11 connect to the terminals 1121, 1122 of the adjacent light source unit 100 forming both an electrical and a mechanical connection. In addition, the links 11 received in two outmost openings 111 may connect to other devices, such as the power source. As shown in FIG. 1, along the X-axis, the two light source units 100 of each line are mechanically connected by one link 11. The link 11 is received in the openings 111, but the pins 119 are insulated from the terminals 1121, 1122.

Figure 4:
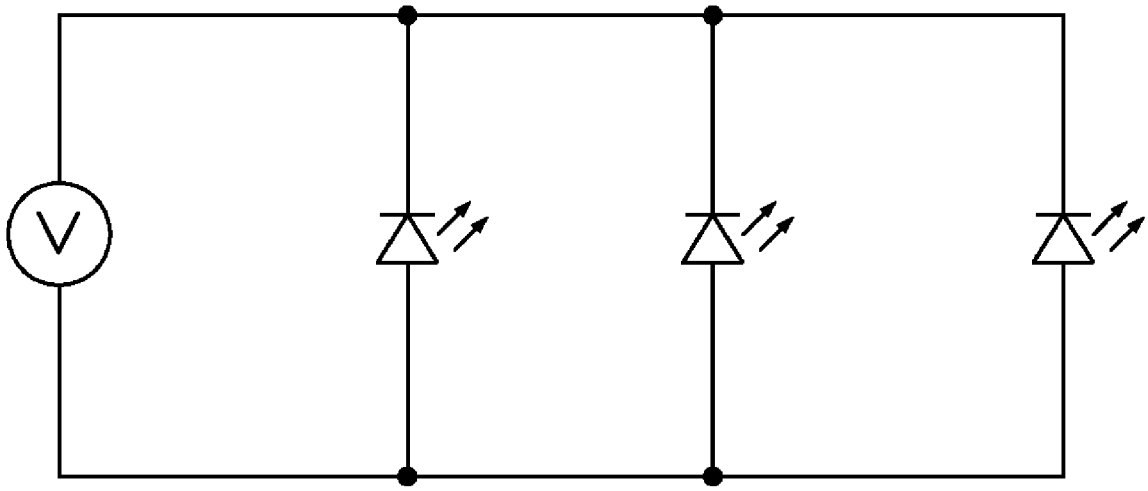
FIG. 4 is a circuit diagram of the light source module of FIG. 1.

A plurality of sealing elements 12 are received in the openings 111 of the light source units 100 without links 11. The sealing elements 12 seal the openings 111 of the light source unit 100 and insulate the connector 112 of the openings 111 without links 11. As shown in FIG. 1, along the X-axis, two sealing elements 12 are received in the two outmost openings 111 of the light source units 100 of each line of the light source module 10. The three light source units 100 of each row are connected in parallel, while the light source units 100 of one row are insulated from the light source units 100 the other row. FIG. 4 is a circuit diagram of the light source units 100 of each row. When the negative and positive poles of the power source are connected with the pins 119 of the two outmost links 11 of each row, the LEDs of the light source units 100 emit light.

The LED of each light source unit 100 is connected to the connector 112, and the LEDs are connected together through the links 11. The power source may be connected to the links 11 to supply electrical current to the LEDs. The metal threads used to connect the LEDs to the power source of the related LED light source are avoided, thus simplifying assembly of the light source units 100. In addition, as the shape and the size of the openings 111 of the light source unit 100 are designed according to the link 11, the light source units 100 are tightly assembled and compact.

Figure 5:
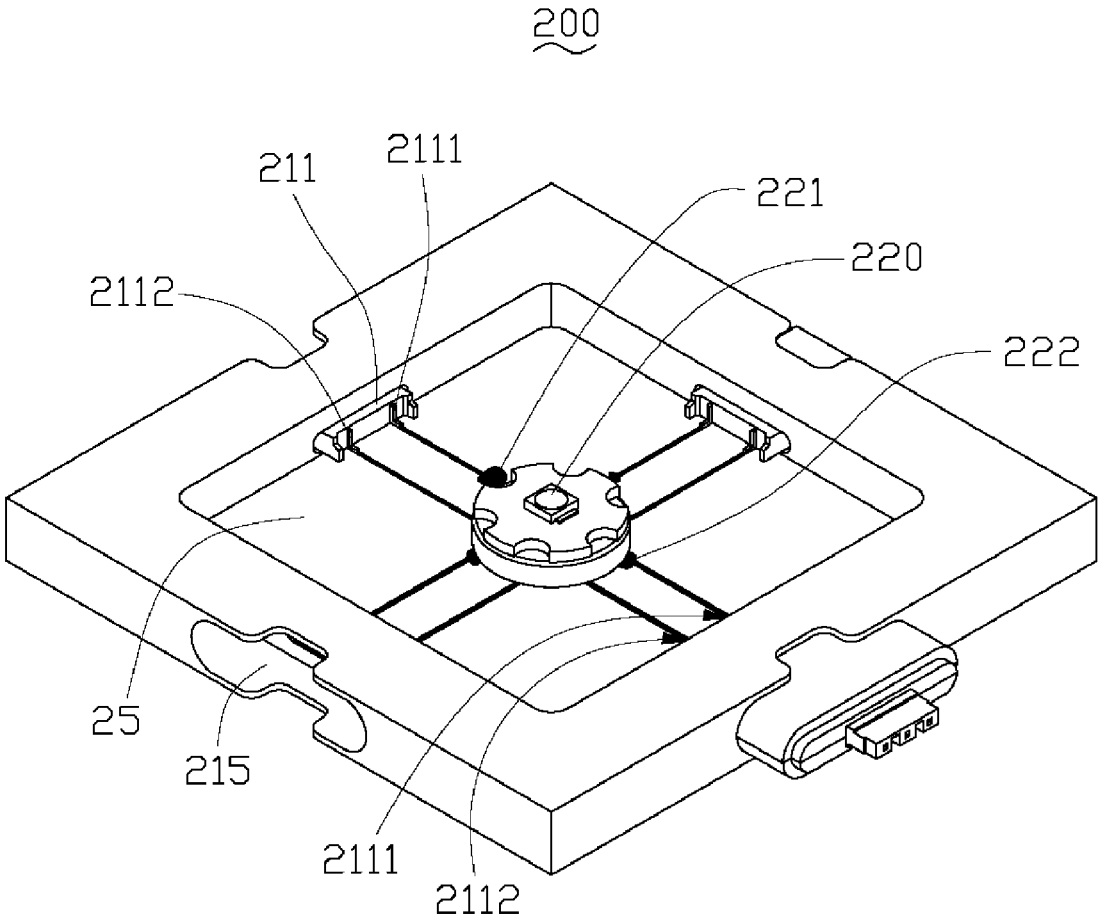
FIG. 5 is an isometric view of another embodiment of the light source unit of the light source module shown without the light guiding plate.
Figure 6:
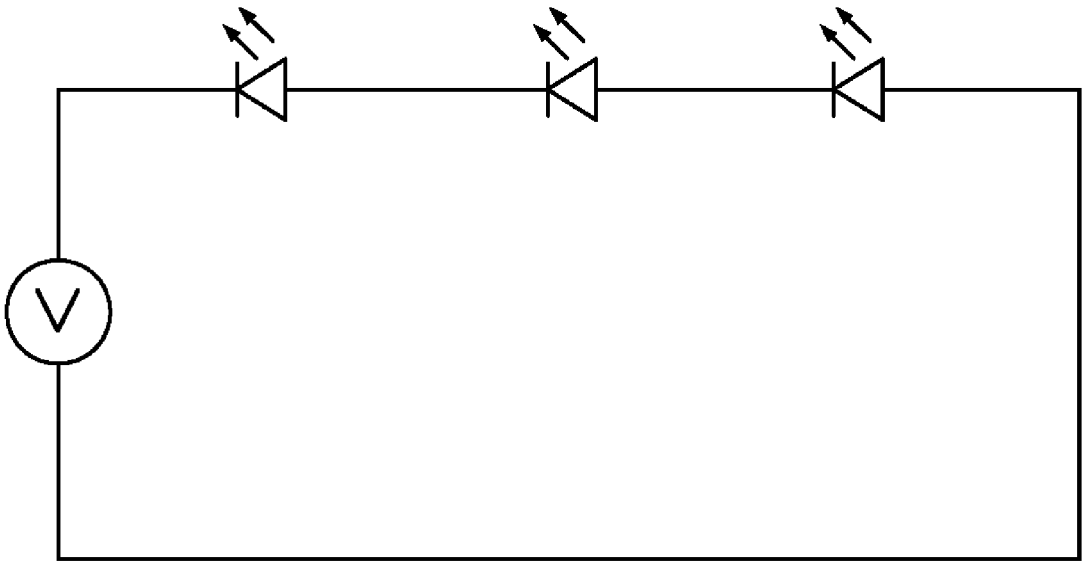
FIG. 6 is a circuit diagram of another embodiment of the light source module using the light source units of FIG. 5.

FIG. 5 shows another embodiment of a light source unit 200. The light source unit 200 includes a substrate 25 and an LED 220. The LED 220 includes a first electrode 221 and a second electrode 222. The substrate 25 defines a number of openings 215. Each opening 215 receives a connector 211 therein. Each connector 211 has a first terminal 2111 and a second terminal 2112. The light source unit 200 is similar to the light source unit 100 of FIG. 2 except the first electrode 221 of the LED 220 is electrically connected to the first terminal 2111 of one connector 211, while the second electrode 222 of the LED 220 is electrically connected to the first terminal 2111 of another connector 211. In the embodiment of FIG. 5, the two electrodes 221, 222 are connected to the first electrodes 2111 of two opposite connectors 211. The second terminals 2112 of the two opposite connectors 211 electrically connect to each other. FIG. 6 is a circuit diagram of a light source module having six light source units 200 assembled as the first embodiment, in two rows of three lines. The light source units 200 of each row are connected in series.

It is to be understood, however, that even though numerous characteristics and advantages of the embodiments have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light source unit, comprising:

a rectangular substrate;

a flange extending from an outer periphery of the rectangular substrate, each side of the flange defining an opening therein;

a plurality of connectors, wherein each connector is arranged in each opening, and comprises a first terminal and a second terminal;

a light emitting diode mounted on the substrate, the light emitting diode comprising a first electrode and a second electrode, the first and second electrodes being electrically connected to the first and second terminals of the connectors; and a light guiding plate optically coupled to the light emitting diode, the light guiding late being rectangular and configured for converting light from the light emitting diode into diffused light, the light guiding plate being coupled to a top surface of the flange thereby defining a closed cavity for receiving the light emitting diode therein, the light guiding plate having a light emitting surface at a top surface thereof.

2. The light source unit of claim 1, wherein the first terminal is connected to the first electrode and the second terminal is connected to the second electrode.

3. The light source unit of claim 1, wherein the first and second electrodes are connected to the first terminals of two of the plurality of connectors, and the second terminals of the two of the plurality of connectors connect to each other.

4. The light source unit of claim 1, wherein the light guiding plate is made of a material selected from the group consisting of polycarbonate, polymethyl methacrylate, polycacrylate, resin, glass, quartz, silicone, and epoxy.

5. The light source unit of claim 1, wherein the light guiding plate has a rough light emitting surface, the rough light emitting surface configured for enhancing diffusion of the light through the light guiding plate.

6. The light source unit of claim 5, wherein the rough light emitting surface is a plurality of pores defined in the light guiding plate, the pores are not larger than 5 mm.

7. The light source unit of claim 5, wherein the rough light emitting surface is a plurality of micro-protrusions formed on the light guiding plate, the micro-protrusions are not larger than 5 mm.

8. The light source unit of claim 1, wherein a plurality of granules are dispersed in the light guiding plate, and the granules have a refractive index different from a refractive index of the material of the light guiding plate, the granules are made of a material selected from the group consisting of $Al_2O_3$, $TiO_2$, $SiO_2$, $SiN_X$, $CaF_2$, $BaSO_4$, ZnO, $B_2O_3$, $Nb_2O_5$, $Na_2O$ and $Li_2O_5$.

9. A light source module, comprising:

a plurality of light source units, each light source unit comprising:

a substrate;

a flange extending from an outer periphery of the substrate, each side of the flange defining an opening therein;

a plurality of connectors, wherein each connector is arranged in each opening, each connector comprising a first terminal and a second terminal;

a light emitting diode mounted on the substrate, the light emitting diode having a first electrode and a second electrode, the electrodes being electrically connected to the terminals of the connectors;

a light guiding plate, the light guiding plate configured for converting light from the light emitting diode into dispersed light, the light guiding plate being mounted on a top of the flange thereby forming a closed cavity for receiving the light emitting diode therein, the light guiding plate having a light emitting surface at a top surface thereof; and a plurality of links, each link being received in a space cooperatively defined by two openings of two neighboring light source units to interconnect the two neighboring light source units.

10. The light source module of claim 9, wherein the light source units are arranged in rows by lines, the light source units of each row are electrically connected by the links.

11. The light source module of claim 10, wherein the first terminal connects to the first electrode and the second terminal connects to the second electrode, so that the light source units of each row are connected in parallel.

12. The light source module of claim 10, wherein the first and second electrodes are connected to the first terminals of two of the plurality of connectors, so that the light source units of each row are connected in series.

13. The light source module of claim 10, wherein the light source units of each line are mechanically connected by the links.

14. The light source module of claim 9, wherein the openings without the links are sealed by a plurality of sealing elements.

15. The light source module of claim 9, wherein the space has substantially the same shape and size of the link.

* * * * *